United States Patent [19]

Abu-Shumays et al.

[11] Patent Number: 4,674,750

[45] Date of Patent: Jun. 23, 1987

[54] DODECAHEDRON CLASS CUBIC PUZZLES

[76] Inventors: Ibrahim K. Abu-Shumays; Mary D. Abu-Shumays, both of 1248 Varner Rd., Pittsburgh, Pa. 15227

[21] Appl. No.: 839,368

[22] Filed: Mar. 14, 1986

Related U.S. Application Data

[63] Continuation-in-part of Ser. No. 687,141, Dec. 28, 1984, abandoned, which is a continuation-in-part of Ser. No. 604,941, Apr. 27, 1984, abandoned, which is a continuation-in-part of Ser. No. 394,869, Jul. 2, 1982, Pat. No. 4,593,907.

[51] Int. Cl.[4] ..... A63F 9/08
[52] U.S. Cl. ..... 273/153 S
[58] Field of Search ..... 273/153 S

[56] References Cited

U.S. PATENT DOCUMENTS

| | | | |
|---|---|---|---|
| 4,451,039 | 5/1984 | Hewlett, Jr. | 273/153 S |
| 4,474,377 | 10/1984 | Ashley | 273/153 S |
| 4,500,090 | 2/1985 | Nieto | 273/153 S |
| 4,558,866 | 12/1985 | Alford | 273/153 S |

FOREIGN PATENT DOCUMENTS

| | | | |
|---|---|---|---|
| 103047 | 3/1984 | European Pat. Off. | 273/153 S |

OTHER PUBLICATIONS

"Mathematical Models", by Cundy & Rollett, published by Oxford Press, 1951, pp. 96 & 97.

*Primary Examiner*—Anton O. Oechsle
*Attorney, Agent, or Firm*—William J. Ruano

[57] ABSTRACT

Two distinct dodecahedron cubic puzzles, one a Rhombic Dodecahedron Puzzle having twelve diamond faces and the other a Regular Dodecahedron Puzzle having twelve pentagon faces. The ideas involved can be readily applied to other puzzles having newer shapes such as the rhombic triacontahedron. The distinguishing features of these puzzles are briefly described. Each of the puzzles is comprised of component pieces which are joined and held together by an appropriate means. The external surfaces of each puzzle are to be assigned a unique combination of colors or pictures or monthly calendars. The mechanism of motion makes it possible to rotate the individual component pieces of a puzzle in groups around lines joining the puzzle center and the puzzle vertices. Various possible rotations (twists and turns) result in mixing up the surface configurations. The object and the challenge is to restore the various surfaces of a puzzle into their original form, or to perform twists and turns that would result in alternate interesting designs.

3 Claims, 6 Drawing Figures

DODECAHEDRON CLASS CUBIC PUZZLES

This is a continuation in part of application Ser. No. 687,141, filed Dec. 28, 1984, involuntarily abandoned, which in turn was a continuation in part of application Ser. No. 604,941, filed Apr. 27, 1984, Abandoned, which in turn was a continuation in part of application Ser. No. 394,869, filed July 2, 1982, now U.S. Pat. No. 4,593,907.

BACKGROUND OF THE INVENTION

1. Field of the Invention

This invention introduces two distinct dodecahedron cubic puzzles. Each puzzle is comprised of various pieces which rotate in groups around lines joining the puzzle center and the puzzle vertices. Admissible rotations alter the surface configurations. The object and the challenge is to perform twists and turns aimed at restoring the surfaces to their original configuration or to other interesting configurations.

2. Description of the Prior Art

This invention introduces dodecahedron cubic puzzles which generalize cubic puzzles similar to those introduced in U.S. patent application Ser. No. 687,141 Filing Date 12/28/1984. One of the new puzzles is a dodecahedron cubic puzzle based on standard regular dodecahedron shapes with twelve identical regular pentagon plane faces. A second puzzle introduced here has the more interesting shape of a rhombic dodecahedron with twelve diamond faces, the same shape as that given in FIG. 9*c* of U.S. Pat. No. 4,593,907.

The regular dodecahedron cubic puzzles of the prior art have each of their pivots or axes of rotation (which emanate from the puzzles core central parts) pointing towards or being attached to centers or center pieces of an external plane face; consequently planes of rotation for the regular dodecahedron puzzles of the prior art are parallel to the plane faces of the underlying dodecahedrons. Here planes of rotation are orthogonal to straight lines which join vertices of the dodecahedrons to the geometric centers of the puzzles and proper rotations of groups of regular polyhedron puzzle component pieces are always around straight lines which join a vertex (a corner point) and the geometric center of the overall dodecahedron shape. Consequently, corner pieces of the dodecahedron puzzles introduced here are restricted to actually and physically rotate in place. Corner component pieces can rotate together with their surrounding edge pieces.

SUMMARY OF THE INVENTION

This invention introduces two alternative puzzles having dodecahedron shapes: (i) one having twelve diamond faces and is comprised of a core central part surrounded by fourteen corner component pieces which rotate in place and which are not visible from the outside, and comprised of a total of 24 externally visible edge component pieces which exchange places as a result of twists and turns, (ii) the second having twelve pentagon plane faces and is comprised of twenty visible corner pieces which are restricted to rotate in place, and thirty edge component pieces which exchange positions as a result of twists and turns. Proper rotations of puzzle component pieces are always around straight lines which join a vertex (a corner point) and the center of the corresponding dodecahedron. Consequently each plane of rotation in the subject puzzle of this invention must be orthogonal (perpendicular) to a straight line joining a vertex and the geometric center of the overall shape.

The puzzles introduced here can be visualized as follows. Consider one of two dodecahedron solids, one a rhomic diamond faced dodecahedron and the other a regular pentagon faced dodecahedon. Associate with each vertex of a dodecahedron one plane of rotation orthogonal (perpendicular) to the straight line which joins that vertex to the geometric center of the dodecahedron solid. The plane of rotation associated with a vertex must be situated such as to pass through the vertices of the dodecahedron which are adjacent to that vertex and which share an edge with that vertex. Now the dodecahedron solid is cut along each of the planes of rotation. The resulting component pieces of the dodecahedron solid are: (i) corner component pieces which may or may not be visible from the outside, (ii) edge component pieces, each predominantly in the form of a tetrahedron with two exposed plane triangular faces, and (iii) a core central piece which may or may not have exposed faces. Connecting means, including knobs and grooves, are introduced such that the component pieces between any vertex of the dodecahedron and its associated plane of rotation can rotate as a group around the straight line joining that vertex and the geometric center of the puzzle.

The ideas in the present invention can be extended and readily applied to puzzles with newer shapes such as the rhombic triacontahedron (details are omitted for brevity). The puzzles introduced here are of the cubic class whereby the surface configurations can be altered by twists and turns and the challenge is to restore the surfaces to the original configuration or to other interesting designs.

No mention is made here of the material to construct these puzzles. It may be plastic, wood, metal, etc., or a combination. The component pieces may be solid or may have hollow insides. Ball bearings or combinations of hemi-spherical surface knobs and grooves to enhance the quality of motion and stabilize the rest positions are desirable as is now standard. Exact dimensions are not mentioned, since this is a relative matter and can be varied. Relative dimensions are provided when essential.

BRIEF DESCRIPTION OF THE DRAWINGS

The following drawings illustrate the basic shapes which are the subject of this invention.

FIG. 3 shows a typical group of component pieces 1, 2, 3, 4, forming a triangular based pyramid which can rotate together in the subject puzzle. The labels 2, 3, 4 will be used interchangeably to denote any edge component piece of the puzzle.

DESCRIPTION OF THE PREFERRED EMBODIMENTS

Figure 1:
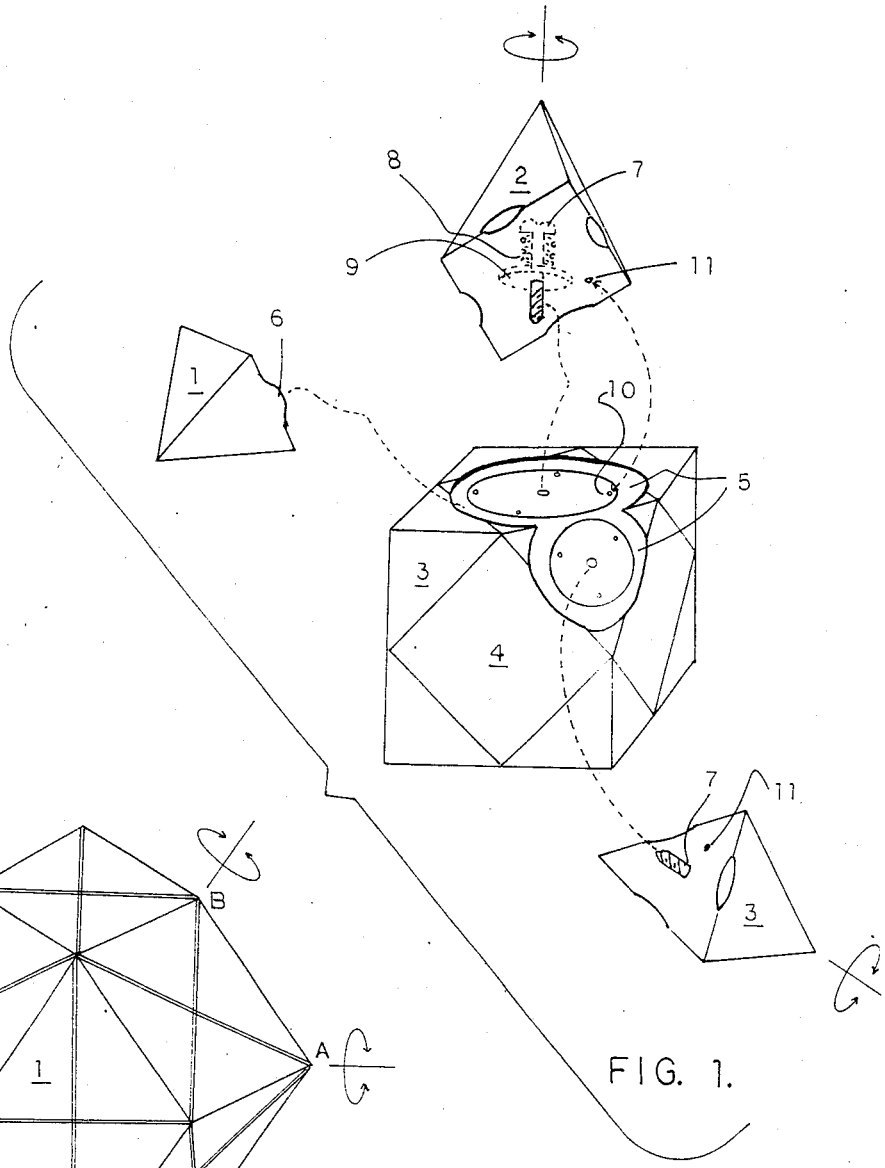
FIG. 1 is a perspective view showing sample component pieces of the rhombic dodecahedron puzzle and, for clarity, showing only a sample of the grooves required for the central component piece 4.

Other objects and advantages of the invention will become more apparent from a study of the summary of the invention, the description of the drawings given above and from the additional description given below. For convenience, a double line notation is adopted in the drawings to indicate separation of adjacent component pieces and also to indicate borders of planes of rotation of component pieces.

The preferred puzzles introduced here have two distict dodecahedron shapes, one a rhombic dodecahedron with twelve identical diamond faces (with one diagonal of each diamond face equal in length to $\sqrt{2}$ times the length of the other diagonal), and the other a regular dodecahedron with twelve identical regular pentagon faces. A plane of rotation is associated with each vertex and is orthogonal (perpendicular) to the straight line joining that vertex to the geometric center of the puzzle. A plane of rotation associated with a vertex passes through the vertices of the dodecahedron which are adjacent to that vertex. The component pieces of the puzzle between a vertex and its associated plane of rotation, can rotate together as a group around the straight line joining that vertex to the center of the puzzle. Ball bearings or combinations of small hemispherical knobs and grooves between puzzle component pieces are introduced in order to stabilize the rest positions.

Additional information related to the present invention is now associated with the two distict dodecahedron shapes: (A) Rhombic Dodecahedron and (B) Regular Dodecahedron.

(A). Rhombic Dodecahedron Puzzle

Figure 2:
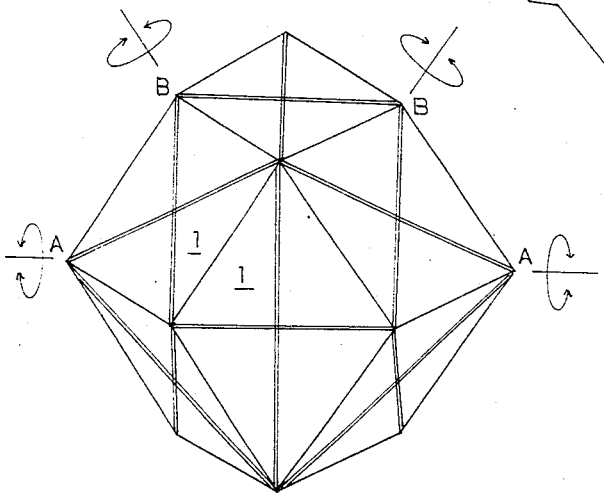
FIG. 2 is a perspective view of the rhombic dodecahedron puzzle showing six of the twelve diamond faces and showing with double lines subdivisions of component pieces and borders of planes of rotation. Each group of externally visible edge component pieces 1 (only one of which is labeled in this figure) sharing a vertex of the dodecahedron puzzle can rotate together with an externally invisible corner component piece around a straight line passing through that vertex and passing through the center of the puzzle. Thus the external edge component pieces 1 can exchange positions as a result of twists and turns.

This puzzle has an overall rhombic dodecahedron shape with twelve identical diamond faces (with one diagonal of each diamond face equal in length to $\sqrt{2}$ times the length of the other diagonal). FIG. 2 is a perspective view of this puzzle. Only the edge component pieces which are predominantly tetrahedrons 1 are visible from the outside in FIG. 2 (only one of these identical edge component pieces is labeled 1 in FIG. 2).

This puzzle has fourteen vertices, each of six vertices is common to four external faces of the rhombic dodecahedron and each of the remaining eight vertices is common to three external faces of the dodecahedron. This rhombic dodecahedron puzzle is subdivided into component pieces along fourteen planes of rotation, each plane of rotation is associated with a vertex of said rhombic dodecahedron and is orthogonal to the straight line joining that vertex and the geometric center of the puzzle. Each plane of rotation associated with a vertex passes through the vertices of the rhombic dodecahedron adjacent to that vertex.

FIG. 1 shows perspective views of typical component pieces of this puzzle. It shows (a) one of six predominantly square based pyramid corner pieces 2, (b) one of eight predominantly triangular based (tetrahedron) pyramid corner pieces 3 (c) one of twenty-four predominantly tetrahedron edge pieces 1, and (d) a core central piece 4 which is predominantly a cuboctahedron.

The cuboctahedron core central piece 4 shown in FIG. 1 can be visualized as being a cube with eight tetrahedron corners cut out of it, each tetrahedron sharing a vertex with the cube and having as its other vertices the centers of the edges of the cube which emanate from that vertex. This core central piece has six square faces and eight equilateral triangular faces. The core central piece is carved around the edges of each of its faces to form parts of fourteen connected internal cylindrical or spherical puzzle grooves, to be referred to as circular grooves, the center or axis of each circular groove is along a line joining a vertex and the geometric center of said rhombic dodecahedron. In order to simplify the illustration, only two of these circular grooves (labeled 5) are drawn in the core central piece 4 shown in FIG. 1.

Each pyramid corner piece 2 or 3 is associated with a vertex of the rhombic dodecahedron, a square based pyramid corner piece 2 sits directly above a square face (which is modified by circular groove) of the core central piece 4, similarly a triangular based pyramid corner piece 3 sits directly above a triangle face (which is modified by circular groove) of the core central piece 4. The edges of the base of each pyramid corner piece 2 or 3, which are adjacent to the core central piece 4 are carved by circular indentations which in the rest positions form extensions and borders for the circular grooves of the core central piece. Each pyramid corner piece 2 and 3 has inside it a smooth top part of a screw pivot 7, a washer 9 and a spring 8 situated around the screw between the head of the screw and the washer. The screw pivot 7 extends through and is fixed to the core central piece 4. Each screw pivot is aligned such that each pyramid corner piece is allowed to rotate freely in place around a straight line which passes through a vertex and the geometric center of the puzzle.

Each square face of the core central piece 4 is further modified at selected positions by four identical hemi-spherical indentations 10. Each triangular face of the core central piece is also further modified at selected positions by three identical hemi-spherical indentations. The base of each pyramid corner piece is modified by a hemi-spherical knob 11 of the same size as the hemi-spherical indentations 10, the knob and the indentations are situated such that the knob sits in one of the indentations in each of the possible rest positions and serves to stabilize the rest positions;

Each of the edge pieces 1 is predominantly a tetrahedron with two exposed and two unexposed triangular faces. Each edge piece 1 has a knob 6 of partly circular surfaces adjoined to its unexposed edge. The knob 6 of each edge component piece fits in the grooves between adjacent component pieces and serves to hold the edge component piece in place in the various possible orientations.

All of the component pieces of the rhombic polyhedron structure which lie between a vertex and its associated plane of rotation can rotate together as a group around the straight line which joins that vertex to the center of the puzzle. Rotations alter the relative positions of the various component pieces of the rhombic dodecahedron puzzle and the challenge is to perform additional rotations to restore the puzzle to its initial configuration or to other interesting configurations.

Finally, note that since the pyramid corner component pieces are not visible from the outside, the shapes of these component pieces can be modified in a number of ways (the size may be reduced slightly, or their vertices may be rounded for example) without affecting the overall shape or the integrity of the puzzle.

(B). Regular Dodecahedron Puzzle

Figure 3:
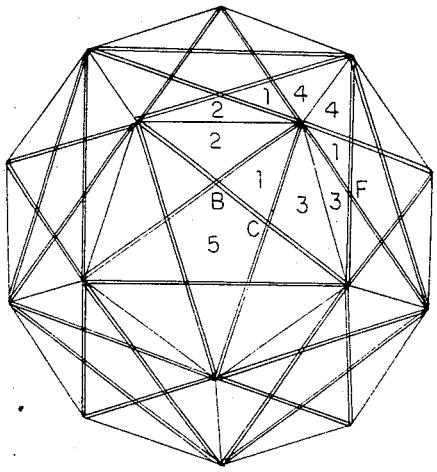
FIG. 3 is a perspective view of a new regular dodecahedron puzzle showing six of the twelve pentagon faces and showing the subdivision (double lines) leading to the various component pieces.

This puzzle has the overall shape of a regular dodecahedron with 12 regular plane pentagon faces. FIG. 3 is a perspective view showing six of the faces of this puzzles and indicating by double lines subdivisions between component pieces and edges of planes of rotation. This puzzle is subdivided into component pieces along twenty distinct planes of rotation, each plane of rotation is orthogonal to a straight line joining a vertex and the geometric center of the overall dodecahedron shape and passing through the three (3) vertices of the dodecahedron which are adjacent to that vertex. The component pieces are: (i) 20 identical corner component pieces 1, (ii) 30 identical edge component pieces as edge pieces 2–4 in FIGS. 3 and 4, and (iii) a core central piece with 12 exposed small regular pentagon faces 5 (see the example 5 labeled in FIGS. 3 and 4).

FIG. 3 shows a typical group of component pieces 1–4 which together form a triangular based pyramid; these pieces 1–4 can rotate together around the line joining their common vertex and the center of the puzzle.

Figure 4:
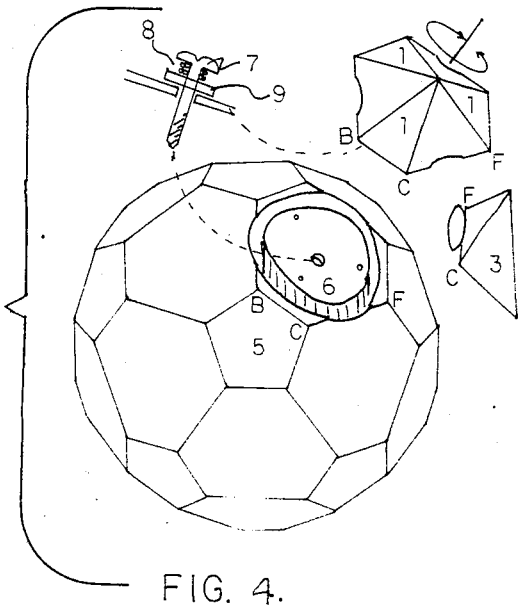
FIG. 4 is a perspective view showing the core central part of the puzzle of FIG. 3 but with only one of the (non-regular) hexagon faces of this core central part modified by (i) a hole at its center which receives a screw 7 from a corner component piece 1, and by (ii) a partly cylindrical or spherical groove (to be referred to as a circular groove) around its long edges (See also FIG. 6); this groove receives knobs attached to edge component pieces 2, 3, 4. This figure also shows a typical corner piece 1 (with indentations along its three edges which are not visible from the outside) that rotates in place and a typical edge piece 3 (with a knob) which migrates from edge to edge. Component piece 1 is joined to the core central part by a screw pivot as indicated in this figure, and this arrangement makes it possible for corner component piece 1 to rotate in place. The same arrangement of grooves, indentations and knobs applies to all hexagon faces of the core central part, to corner and to edge component pieces, though not shown in the illustrations.

The core central piece of the puzzle has a basic polyhedron structure with 12 small regular pentagon faces 5 and twenty non-regular hexagon faces 6, each hexagon face has three equal short sides and three equal long sides. Parts of the core central piece are carved around the long sides of each hexagon face to form parts of twenty connected internal circular puzzle grooves. The center of each circular groove is along on a line joining a vertex and the geometric center of the overall regular dodecahedron puzzle shape. FIG. 4 shows a view of the core central piece of the puzzle but with only one of its externally non-visible (non-regular) hexagon faces 6 properly modified by a circular groove to accommodate knobs of edge component pieces.

FIG. 4 shows a perspective view of a typical corner component piece 1 that rotates in place above a face 6 of the core central pieces, and also shows a typical modified tetrahedron edge component piece 3 which migrates from edge to edge and which has a knob which fits in the grooves and prevents disassembly of the puzzle.

Figure 5:
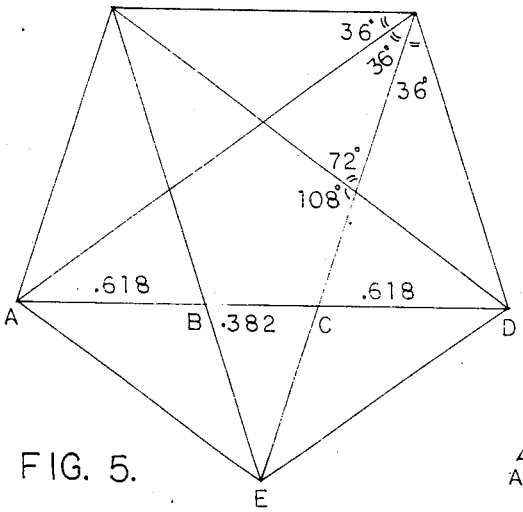
FIG. 5 shows a magnified typical face of the regular dodecahedron puzzle of FIG. 3 with single rather than double lines indicating the subdivisions of component pieces. This figure also indicates the sizes of typical angles and the relative sizes of edges of component pieces.
Figure 6:
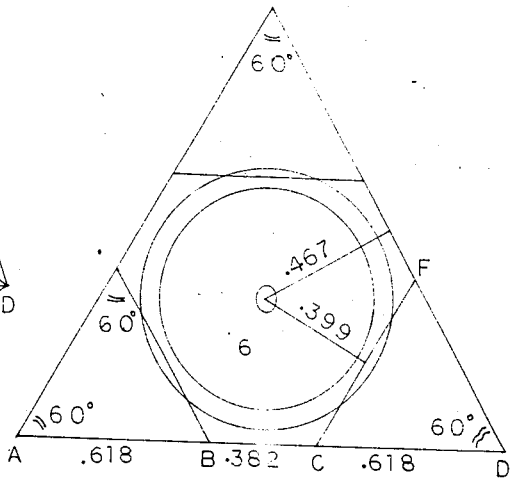
FIG. 6 is similar to FIG. 5 and shows a magnified view of a typical base of the pyramid of the adjacent component pieces 1, 2, 3, 4 of FIG. 3 which can rotate jointly.

FIG. 5 shows a single face of the dodecahedron of FIG. 3 slightly magnified and with subdivisions indicated by single rather than double lines. If the length of a typical edge of the overall dodecahedron shape is assumed to be 1 (unity), then the length of the various lines in FIG. 5 are approximately as indicated in this figure (line AB=0.618034, line BC=0.381966, etc.). The dimensions listed in FIGS. 5 and 6 can be figured out from knowledge of the various angles involved which are also indicated in these figures. The important point to note is that the triangular base of a typical pyramid such as formed by the component pieces marked 1–4 in FIG. 3 is an equilateral triangle as given in FIG. 6 with dimensions corresponding to those of FIG. 5. Here the line CF which corresponds to an internal edge of an edge component piece, such as pieces 2–4 in FIGS. 3 and 4, is closer to the centroid O of the triangle in FIG. 6 than the typical edge BC of a corner component piece 1 (BC is also an edge of the small central pentagon 5 of FIG. 3) and thus circular grooves can be constructed as in FIGS. 4 and 6 without affecting the edges of the central pentagons 5 shown in FIGS. 3 and 4. In brief, FIGS. 5 and 6 are intended to illustrate that circular grooves, completely invisible from the outside can be constructed around the three long edges of each hexagon face of the core central piece for the purpose of holding knobs of edge component pieces and for making possible migrations of edge component pieces from place to place.

Each pyramid corner piece 1 is associated with a vertex of the regular dodecahedron puzzle shape. Each pyramid corner piece sits directly above a plane of rotation and is joined along the center of its base to the center of a hexagon face 6 of the core central piece. Such joining is by means of a screw pivot 7 having a smooth top part, the screw pivot 7 is supported at its head and surrounded by a spring 8 which sits on a washer 9 around a smooth part of the screw pivot. The spring 8, the washer 9, and the top part of the screw pivot 7 are situated inside the pyramid corner piece 1. The screw pivot 7 extends through and is fixed to the core central part. Each screw pivot is aligned such that each pyramid corner piece is allowed to rotate freely in place around a straight line which passes through a vertex and the geometric center of the puzzle.

In the rest positions, the internal edges CF of each corner component piece 1 lie along intersections of planes of rotation and coincide with long edges CF of the core central piece. Each pyramid corner pieces 1 associated with a vertex of the regular polyhedron shape has circular indentations along its long edges CF which coincide with the plane of rotation associated with that vertex, the indentations form extensions and borders of the internal circular puzzle grooves in the core central piece of the puzzle.

Each hexagonal face 6 of the core central piece is further modified at selected positions by three small identical hemi-spherical indentations. The base of each pyramid corner piece is modified by a hemi-spherical knob of the same size as the hemi-spherical indentations. The knob and the indentations are situated such that the knob sits in one of the indentations in each of the possible rest positions and serves to stabilize the rest positions.

Each of the edge pieces 2–4 is predominantly a tetrahedron with two exposed and two unexposed triangular faces and with a knob of partly circular surfacs adjoined to its unexposed edge CF as in FIG. 4. The knob fits in the grooves between adjacent component pieces and serves to hold the edge component piece in place in the various possible orientations.

All of the component pieces of the regular polyhedron puzzle which lie between a vertex and its associated plane of rotation, such as component pieces 1–4 in FIG. 3 can rotate together as a group around the straight line which joins that vertex to the center of the puzzle. Rotations alter the relative positions of the various component pieces of the regular dodecahedron puzzle and the challenge is to perform additional rotations to restore the puzzle to its initial configuration or to other interesting configurations.

While we have illustrated and described two preferred embodiments of our invention, it will be understood that these are by way of illustration only and that various changes, extensions and modifications are contemplated in this invention and within the scope of the following claims.

We claim:

1. In a puzzle with a geometric structure having N identical faces where N is at least eight; said puzzle being subdivided into component pieces along planes of rotation, one place of rotation is associated with each vertex of said geometric structure and is orthogonal to the straight line joining the vertex and the geometric center of the puzzle; each plane of rotation associated with a vertex passes through the vertices of said geometric structure adjacent to that vertex (each adjacent vertex sharing an edge of the geometric structure with that vertex);

said component pieces are comprised of (a) corner pieces, (b) predominantly tetrahedron edge pieces, and (c) a core central piece;

parts of said core central piece, around its externally invisible edges along the planes of rotation, are carved to form connected internal circular puzzle grooves with the center of each circular groove being on a line joining a vertex and the geometric center the puzzle;

each corner piece is associated with a vertex of said geometric structure; each corner piece sits directly above a plane of rotation and is joined, along the center of its face which coincides with that plane of rotation, to a face of the core central piece, such joining is by means of a screw pivot having a smooth top part, said screw pivot is supported at its head and surrounded by a spring which sits on a washer around a smooth part of the screw pivot; the spring, the washer, and the top part of the screw pivot are situated inside the corner piece, the screw pivot extends through and is fixed to said core central piece; each screw pivot is aligned such that each corner piece is allowed to rotate freely in place around a straight line which passes through a vertex and the geometric center of the puzzle; each corner piece associated with a vertex of said geometric structure has circular indentations along its externally invisible edges which coincide with the plane of rotation associated with that vertex; said indentations form extensions and borders of said internal circular puzzle grooves;

each face of said core central piece which in any rest position sits abutting a face of a corner piece is modified at selected positions by identical hemi-spherical indentations, the abutting face of the corner piece is modified by a hemi-spherical knob of the same size as the hemi-spherical indentations, the knob and the indentations are situated such that the knob sits in one of the indentations in each of the possible rest positions and serves to stabilize the rest positions;

each of said edge pieces is predominantly a tetrahedron with two exposed and two unexposed triangular faces and with a knob of partly circular surfaces adjoined to an unexposed edge; said knob fits in the grooves defined in part by the circular grooves in the adjacent faces of the core central piece and in part by the circular indentations of the adjacent corner pieces, said knob serves to hold the edge component piece in place in the various possible orientations;

all of the component pieces of said geometric structure which lie between a vertex of and its associated plane of rotation can rotate together as a group around the straight line which joins that vertex to the center of the puzzle; rotations alter the relative positions of the various component pieces and the challenge is to perform additional rotations to restore the puzzle to its initial configuration or to other interesting configurations.

2. In a geometric puzzle having the overall shape of a rhombic dodecahedron having twelve identical diamond faces and having fourteen vertices; said rhombic dodecahedron being subdivided into component pieces along fourteen planes of rotation, each plane of rotation is associated with a vertex of said rhombic dodecahedron and is orthogonal to the straight line joining that vertex and the geometric center of the puzzle; each plane of rotation associated with a vertex passes through the vertices of the rhombic dodecahedron adjacent to that vertex (each adjacent vertex shares an edge of the dodecahedron with that vertex);

said component pieces are comprised of (a) six predominantly square based pyramid corner pieces, (b) eight predominantly equilateral triangle based (tetrahedron) pyramid corner pieces, (c) twenty-four predominantly tetrahedron edge pieces, and (d) a core central piece which is predominantly a cuboctahedron (the cuboctahedron here can be visualized as being a cube with eight tetrahedron corners cut out of it, each tetrahedron corner sharing a common vertex with the cube and having as its other vertices the centers of the edges of the cube which emanate from that common vertex; this cuboctahedron has six square faces and eight equilateral triangular faces);

parts of said core central piece are carved around its edges to form parts of fourteen connected internal circular puzzle grooves with the center of each circular groove being on a line joining a vertex and the geometric center of said rhombic dodecahedron;

each pyramid corner piece is associated with a vertex of said rhombic dodecahedron; each pyramid corner piece sits directly above a plane of rotation and is joined along the center of its base to the core central piece by means of a screw pivot having a smooth top part, said screw pivot is supported at its head and surrounded by a spring which sits on a washer around a smooth part of the screw pivot; the spring, the washer, and the top part of the screw pivot are situated inside the pyramid corner piece, the screw pivot extends through and is fixed to said core central piece; each screw pivot is aligned such that each pyramid corner piece is allowed to rotate freely in place around a straight line which passes through a vertex and the geometric center of the puzzles; each pyramid corner piece associated with a vertex of said rhombic dodecahedron structure has circular indentations along its edges which coincide with the plane of rotation associated with that vertex; said indentations form extensions and borders of said internal circular puzzle grooves;

each square face of said core central piece is further modified at selected positions by four small identical hemi-spherical indentations, each triangular face of said core central piece is further modified at selected positions by three small identical hemi-spherical indentations, the base of each pyramid corner piece is modified by a hemi-spherical knob of the same size as the hemi-spherical indentations, the knob and the indentations are situated such that the knob sits in one of the indentations in each of the possible rest positions and serves to stabilize the rest positions;

each of said edge pieces is predominantly a tetrahedron with two exposed and two unexposed triangular faces and with a knob of partly circular surfaces adjoined to an unexposed edge; said knob fits in the grooves defined in part by the circular grooves in the adjacent faces of the core central piece and in part by the circular indentations of the adjacent corner pieces, said knob serves to hold the edge component piece in place in the various possible orientations;

all of the component pieces of said rhombic dodecahedron which lie between a vertex and its associated plane of rotation can rotate together as a group around the straight line which joins that vertex to the center of the puzzle; rotations alter the relative positions of the various component pieces of said rhombic dodecahedron and the challenge is to perform additional rotations to restore the puzzle to its initial configuration or to other interesting configurations.

3. In a geometric puzzle having the overall shape of a regular dodecahedron having twelve identical pentagon faces and having twenty vertices; said regular dodecahedron being subdivided into component pieces along twenty planes of rotation, each plane of rotation is associated with a vertex of said regular dodecahedron and is orthogonal to the straight line joining that vertex and the geometric center of the puzzle; each plane of rotation associated with a vertex passes through the vertices of the regular dodecahedron adjacent to that vertex (each adjacent vertex shares an edge of the dodecahedron with that vertex);

said component pieces are comprised of (a) twenty identical predominantly hexagon based pyramid corner pieces, the hexagon base of each having three long sides and three short sides, (b) thirty predominantly tetrahedron edge pieces, and (c) a core central piece; said core central piece having a solid shape with twelve identical externally visible small pentagon faces and twenty hexagon faces, each hexagon face having the same size and shape as the hexagon bases of said pyramid corner pieces;

said hexagon faces each being provided with a circular groove with the grooves being connected at the adjoining long edges of the hexagonal faces and with the center of each circular groove being on a line joining a vertex and the geometric center of said regular dodecahedron;

each pyramid corner pieces is associated with a vertex of said regular dodecahedron; each pyramid corner piece sits directly above a plane of rotation and is joined along the center of its base to the center of a hexagon face of the core central piece, such joining is by means of a screw pivot having a smooth top part, said screw pivot is supported at its head and surrounded by a spring which sits on a washer around a smooth part of the screw pivot; the spring, the washer, and the top part of the screw pivot are situated inside the pyramid corner piece, the screw pivot extends through and is fixed to said core central piece; each screw pivot is aligned such that each pyramid corner piece is allowed to rotate freely in place around a straight line which passes through a vertex and the geometric center of the puzzle; each pyramid corner piece associated with a vertex of said regular polyhedron structure has circular indentations along its long edges which coincide with the plane of rotation associated with that vertex; said indentations form extensions and borders of said internal circular puzzle grooves;

each hexagonal face of said core central piece is further modified at selected positions by three small identical hemi-spherical indentations, the base of each pyramid corner piece is modified by a hemi-spherical knob of the same size as the hemi-spherical indentations, the knob and the indentations are situated such that the knob sits in one of the indentations in each of the possible rest positions and serves to stabilize the rest positions;

each of said edge pieces is predominantly a tetrahedron with two exposed and two unexposed triangular faces and with a knob of partly circular surfaces adjoined to an unexposed edge; said knob fits in the grooves defined in part by the circular grooves in the adjacent faces of the core central piece and in part by the circular indentations of the adjacent corner pieces, said knob serves to hold the edge component piece in place in the various possible orientations;

all of the component pieces of said regular polyhedron structure which lie between a vertex and its associated plane of rotation can rotate together as a group around the straight line which joins that vertex to the center of the puzzle; rotations alter the relative positions of the various component pieces of said regular dodecahedron and the challenge is to perform additional rotations to restore the puzzle to its initial configuration or to other interesting configurations.

* * * * *